US006499955B2

(12) United States Patent
Choi et al.

(10) Patent No.: US 6,499,955 B2
(45) Date of Patent: Dec. 31, 2002

(54) CENTRIFUGAL COMPRESSOR STRUCTURE WITH IMPELLERS

(75) Inventors: Moon-Chang Choi, Kyounggi-do (KR); Sang-Wook Lee, Kyounggi-do (KR); Young-Kwan Kim, Incheon (KR); Yoo-Chol Ji, Incheon (KR); Kwang-ha Suh, Koonpo-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/817,376

(22) Filed: Mar. 27, 2001

(65) Prior Publication Data

US 2002/0037215 A1 Mar. 28, 2002

(30) Foreign Application Priority Data

Sep. 27, 2000 (KR) ..... 2000-56781

(51) Int. Cl.[7] ..... F04D 29/28

(52) U.S. Cl. ..... 416/185; 416/198 R; 416/198 A; 415/199.1

(58) Field of Search ..... 416/182, 185, 416/228, 223 B, 198 R, 198 A; 415/199.1

(56) References Cited

U.S. PATENT DOCUMENTS 2,941,780 A * 6/1960 Von Der Nuell et al. ... 416/186 R
4,060,337 A * 11/1977 Bell, III ..... 416/186 R
4,385,866 A * 5/1983 Ochiai et al. ..... 416/241 B
4,530,639 A * 7/1985 Mowill ..... 415/98
5,555,956 A * 9/1996 Voss et al. ..... 184/6.16

* cited by examiner

*Primary Examiner*—Edward K. Look
*Assistant Examiner*—Ninh Nguyen
(74) *Attorney, Agent, or Firm*—Birch, Stewart, Kolasch & Birch, LLP

(57) ABSTRACT

A centrifugal compressor includes first and second impellers coupled to opposite ends of a drive shaft. Each impeller includes a hub with a plurality of blades on a front face. The blades compress a fluid, while forcing the fluid off an outer periphery of the hub. At least one of the impellers includes a plurality of uniformly shaped pressure attenuating grooves provided around its outer periphery. The pressure attenuating grooves reduce an axial load applied to the impeller, and act to balance the overall resultant axial load applied to the drive shaft by the two impellers, thereby reducing wear on thrust bearings engaging the rotating drive shaft.

13 Claims, 4 Drawing Sheets

CENTRIFUGAL COMPRESSOR STRUCTURE WITH IMPELLERS

BACKGROUND OF THE INVENTION

1. Field of the Invention

The present invention relates to a centrifugal compressor capable of compressing a fluid, in particular to a centrifugal compressor structure with impellers adapted to convert kinetic energy generated from a motor into pressure energy, in which each of the impellers adjusts an axial load, thereby appropriately adjusting a load applied to a thrust bearing.

2. Description of the prior Art

Generally, compressors are adapted to convert mechanical energy generated by a motor into pressure energy, thereby increasing the pressure of a fluid. In particular, centrifugal compressors, to which the present invention relates, are adapted to conduct a compression for a fluid by use of the rotating force of an impeller while sucking the fluid in an axial direction, and discharging the sucked fluid in a centrifugal direction. Typically, such centrifugal compressors include multiple stages so that they operate in a multi-stage compression. In particular, two-stage centrifugal compressors including two stages of compression are mainly used.

Such centrifugal compressors are mainly used in air conditioners and specific military equipment. In accordance with the capacity of a fluid to be compressed, centrifugal compressors are classified into those of a large capacity and those of a small capacity.

FIG. 1 is a sectional view illustrating the structure of a conventional two-stage centrifugal compressor.

Referring to FIG. 1, the conventional two-stage centrifugal compressor is of a back-to-back type in which impellers face each other at their back surfaces. Now, the structure of this centrifugal compressor will be described in conjunction with FIG. 1.

As shown in FIG. 1, the centrifugal compressor includes a motor case 1 having a desired shape to receive units including a motor while isolating those units from the outside. The motor, which is denoted by the reference numeral 2, is also included in the centrifugal compressor. The motor 2 is disposed in the motor case 1 and adapted to convert electric energy into mechanical kinetic energy.

The centrifugal compressor also includes a drive shaft 3 axially coupled to the motor 2 to rotate along with the drive shaft 3. A pair of impellers, that is, a first impeller 4 and a second impeller 5, are coupled to opposite ends of the drive shaft 3, respectively, and convert a rotating movement of the drive shaft 3 into kinetic energy to be applied to a fluid. The centrifugal compressor further includes thrust bearings 6 disposed at a portion of the drive shaft 3 in the vicinity of a first end of the drive shaft 3. The thrust bearings 6 are adapted to gently support a thrust load axially applied to the drive shaft 3.

A pair of radial bearings 7 and 8 are respectively disposed at portions of the drive shaft 3 in the vicinity of opposite ends of the drive shaft 3. The radial bearings 7 and 8 are adapted to radially support the drive shaft 3, thereby gently supporting a radial load. A pair of bearing plates, that is, a first bearing plate 9 and a second bearing plate 10, each interposed between the motor case 1 and an associated one of the radial bearings 7 and 8, are adapted to allow the associated radial bearing to be supported by the motor case 1.

A bearing cover 11 is fitted around the first end of the drive shaft 3 installed with the trust bearings 6 while being fitted in a first end of the motor case 1 corresponding to the end of the drive shaft 3. The bearing cover 11 seals the interior of the motor case 1. A pair of diffusers, that is, a first diffuser 12 and a second diffuser 13, are arranged at respective discharge ends of the impellers 4 and 5 in order to convert kinetic energy, possessed in the fluid discharged at a high velocity from the impellers 4 and 5, into pressure energy.

A first volute case 14 is mounted to the outside of the first diffuser 12. The first volute case 14 has a desired shape to collect the fluid discharged in a compressed state from the first diffuser 12 while reducing the pressure energy possessed in the discharged fluid. A connecting tube 15 is connected at one end thereof to the first volute case 14 to guide the fluid discharged from the first volute case 14 toward the second impeller 5. A second volute case 16 is mounted to the outside of the second diffuser 13. The second volute case 16 is connected to the other end of the connecting tube 15 to temporarily collect the fluid emerging from the connecting tube 15, and then being compressed again while passing sequentially through the second impeller 5 and the second diffuser 13.

The centrifugal compressor further includes a plurality of uniformly-spaced fluid passages 17. The fluid passages 17 extend axially through the second bearing plate 10 and are adapted to allow the high pressure fluid collected in the second volute case 16 to be discharged from the second volute case 16. A motor chamber 18 is defined between the first and second bearing plates 9 and 10 in the interior of the motor case 1. The motor chamber 18 receives the fluid discharged through the fluid passages 17 and allows the received fluid to stay temporarily therein while cooling the motor 2.

The centrifugal compressor also includes a labyrinth seal 19 formed at a surface of the bearing cover 11 contacting the drive shaft 3. The labyrinth seal 19 is adapted to prevent the high pressure fluid filled in the motor chamber 18 from being leaked outwardly from the motor chamber 18. A discharge tube 20 is connected at one end thereof to a desired portion of the motor case 1, while communicating with the motor chamber 18 and adapted to discharge the high pressure fluid from the motor chamber 18. A suction tube 21 is connected to the first volute case 14 upstream from the first impeller 4.

The operation of the two-stage centrifugal compressor will now be described in brief. A fluid to be compressed is introduced into the centrifugal compressor via the suction tube 21. The introduced fluid is primarily compressed by the first impeller 4, and then forced to pass through the first diffuser 12, so that it is highly pressurized. The high pressure fluid is then collected by the first volute case 14 without any loss of pressure. The collected fluid is introduced into the second impeller 5 which, in turn, secondarily compresses the fluid. The secondarily compressed fluid is then further compressed to a higher pressure while passing through the second diffuser 13, and then collected in the second volute case 16. The high pressure fluid is then introduced into the motor chamber 18 via the fluid passages 17, so that it cools the motor 2 heated to a high temperature. After cooling the motor 2, the fluid is outwardly discharged from the motor chamber 18 via the discharge tube 20.

During the above operation, considerably high pressure is applied to the first and second impellers 4 and 5. Due to such high pressure, a high load is applied to the thrust bearings 6. Now, effects resulting from such a load will be described in detail.

FIG. 2 is a plan view illustrating one of the impellers used in the above mentioned conventional centrifugal compressor, that is, the impeller 4.

Referring to FIG. 2, the impeller 4 has a structure in which a plurality of blades 4*b* are mounted around a cylindrical hub 4*a*. Once an external fluid is axially introduced into the center of the impeller 4 during a rotation of the impeller 4, it is then forced to move in a centrifugal direction along the blades 4*b* conducting a rotation. As the fluid moves in the centrifugal direction, it possesses kinetic energy, so that it is converted into a fluid having high energy, that is, a high pressure fluid flowing at a high velocity.

FIG. 3 is a sectional view illustrating the impeller 4 used in the conventional centrifugal compressor.

As shown in FIG. 3 and mentioned above, the impeller 4 includes the hub 4*a* forming a body of the impeller 4. The blades 4*b* are mounted to a front surface of the hub 4*a*. The fluid, which has been changed into a high pressure fluid flowing at a high velocity while passing the blades 4*b*, is further compressed at the back side of the impeller 4, so that an increased axial load is applied to the impeller 4.

The load applied to the impeller 4 due to the above mentioned operation is schematically illustrated in FIG. 4.

As apparent from FIG. 4, the fluid exerting its pressure on the impeller 4 strongly pushes the impeller 4 in a forward direction while slightly pushing the impeller 4 in a backward direction because the fluid reaching the back surface of the impeller 4 after passing the blades 4*b* has a pressure considerably higher than the pressure of the fluid exerting on the front surface of the impeller 4. As a result, the impeller 4 generates a force urging it in a direction from the back surface thereof to the front surface thereof. Such an urging force is also generated at the impeller 5. These pushing forces are vector-summed, thereby leaving a force F which is, in turn, applied to the drive shaft 3.

At this time, the fluid pressures respectively radially applied to the impellers 4 and 5 disappear because they are offset by each other by virtue of the symmetrical arrangement of the impellers 4 and 5.

In the above mentioned configuration, the axial load applied to each impeller is supported by the thrust bearings (denoted by the reference numeral 6 in FIG. 1). That is, the axial load is continuously applied to the thrust bearings 6. As a result, the thrust bearings 6 may be eventually damaged.

In order to solve this problem, a method has been proposed in which respective outer diameters of the impellers 4 and 5 are adjusted, based on a difference between the pressures respectively applied to the impellers 4 and 5 arranged at opposite ends of the drive shaft 3, to offset axial loads respectively applied to the impellers 4 and 5. However, such an adjustment for the diameters of the impellers 4 and 5 results in an undesirable variation in compression ratio. For this reason, there is a difficulty in determining an appropriate compression ratio when the centrifugal compressor is designed.

SUMMARY OF THE INVENTION

Therefore, the present invention has been made to overcome the above mentioned problems, and an object of the present invention is to provide a centrifugal compressor structure with impellers, in which the axial load generated from each of the impellers respectively coupled to opposite ends of a drive shaft can be adjusted without any reduction of the outer diameter of the impeller, so that errors generated during the manufacture of the compressor are reduced, thereby allowing the compressor to be more conveniently manufactured.

In accordance with the present invention, this object is accomplished by providing a centrifugal compressor structure including at least one impeller, the impeller comprising: a hub coupled to a drive shaft and adapted to receive a rotating force from a motor via the drive shaft so that it rotates; a plurality of blades provided at a front surface of the hub and adapted to receive a rotating force from the hub, thereby compressing an external fluid while forcing the fluid to flow from an upstream end of the hub to a downstream end of the hub; and a plurality of uniformly-shaped pressure attenuating grooves provided at an outer peripheral edge of the hub and adapted to reduce an axial load applied to the impeller.

The pressure attenuating grooves are formed while having no influence on the blades. These pressure attenuating grooves serve to reduce a load resulting from a high hydraulic pressure exerted on the back surface of the impeller.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Figure 5:
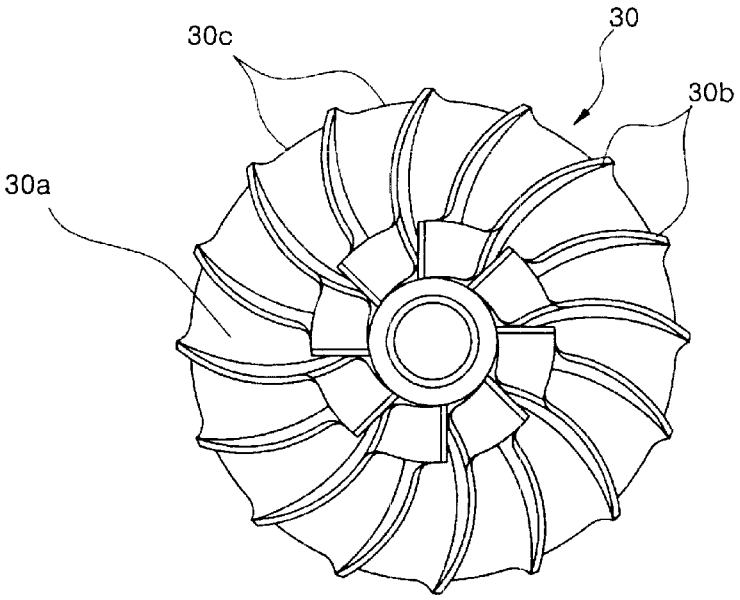
FIG. 5 is a plan view illustrating an impeller used in a centrifugal compressor according to an embodiment of the present invention.
Figure 6:
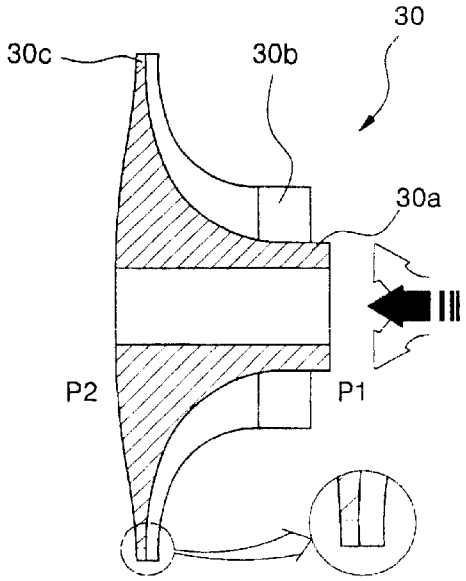
FIG. 6 is a sectional view illustrating the impeller according to the embodiment of the present invention.

FIG. 5 is a plan view illustrating an impeller used in a centrifugal compressor according to an embodiment of the present invention. FIG. 6 is a sectional view illustrating the impeller of FIG. 5.

Referring to FIGS. 5 and 6, the impeller denoted by the reference numeral 30 includes a hub 30*a* forming a body of the impeller 30, and a plurality of uniformly spaced blades 30*b* provided at the front surface of the hub 30*a* and adapted to apply a pressure to a fluid while rotating along with the hub 30*a* when the hub 30*a* rotates. The impeller 30 also includes a plurality of uniformly spaced pressure attenuating grooves 30*c* formed at an outer peripheral edge portion of the hub 30*a* disposed at a downstream end, that is, a back end, of the hub 30*a*. Each pressure attenuating groove 30*c* is arranged between adjacent ones of the blades 30*b* while having a desired depth. The pressure attenuating grooves 30*c* serve to reduce a pressure applied to the back surface of the impeller 30 by a high pressure fluid passing the blades 30*b*.

As mentioned above, the pressure attenuating grooves 30*c* are formed at the outer peripheral edge portion of the hub 30*a*. In order to allow the impeller 30 to have a symmetrical structure with respect to a central axis thereof, thereby preventing the impeller 30 from generating impact such as vibrations during a rotation thereof, it is preferred that the pressure attenuating grooves 30*c* be arranged while being uniformly spaced from one another. In the illustrated case, the pressure attenuating grooves 30*c* are arranged between adjacent ones of the blades 30*b* while having the same shape, respectively.

The operation of the impeller will be described in detail with reference to the above mentioned impeller structure according to the present invention.

The present invention is adapted to improve adverse effects applied to thrust bearings (denoted by the reference numeral 6 in FIG. 1) due to the structure of the impeller. Once a fluid is axially introduced into the impeller 30 at the central portion of the front surface of the impeller 30, it receives a centrifugal force generated by virtue of a rotation of the impeller 30. Because of the centrifugal force, the fluid is forced to flow toward the outer edge portion of the impeller 30 disposed at the downward end of the impeller 30 while being accelerated, so that it has a high pressure.

Thus, the fluid discharged from the impeller 30 is maintained at a high pressure. The high pressure of the fluid discharged from the impeller 30 is exerted on the back surface of the impeller 30.

As well known, when a pressure is exerted on a face having a certain area, a force effecting in the same direction as the pressure is applied to the face due to the pressure. This force can be expressed by the following expression:

$$F=P*A \qquad \text{[Expression 1]}$$

where, F represents the force applied to the face, P represents a pressure applied to the face, and A represents the area of the face on which the pressure P is exerted.

Forces generated at the impeller 30 due to the high pressure fluid passing the impeller 30 will be described in conjunction with Expression 1.

Figure 7:
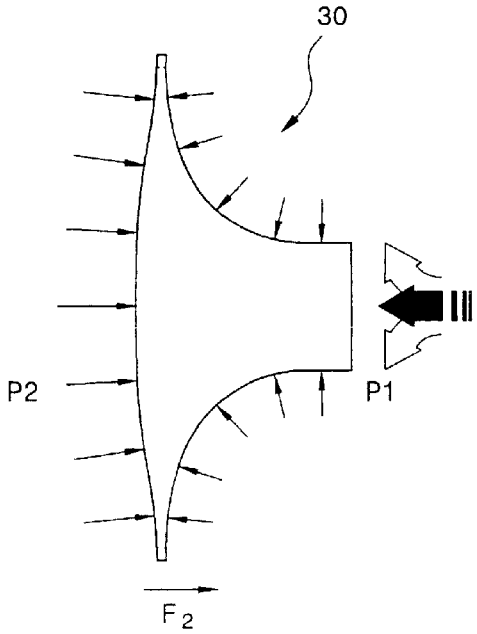
FIG. 7 is a schematic view illustrating a load applied to the impeller according to the embodiment of the present invention.

As shown in FIG. 7, a low pressure $P_1$ is applied to the front surface of the impeller 30 because the fluid exerted on the front surface of the impeller 30 is in an uncompressed state. On the other hand, a high pressure $P_2$ is applied to the back surface of the impeller 30 because the fluid exerted on the back surface of the impeller 30 is in a compressed state.

Although the front surface of the impeller 30 has a complex shape, the pressure-exerted area of that front surface may be divided into horizontal pressure-exerted area portions, to which pressure is horizontally applied, and vertical pressure-exerted area portions, to which pressure is vertically applied, taking into consideration the fact that pressure is always exerted on a face in a direction perpendicular to the plane of the face. Similar to the front surface, the pressure-exerted area of the back surface of the impeller 30 may be divided into horizontal pressure-exerted area portions and vertical pressure-exerted area portions.

Of the vertical pressure-exerted area portions, those respectively arranged at opposite directions have the same area because the impeller 30 has a symmetrical structure in all vertical directions throughout 360° about a horizontal axis corresponding to the central axis of the impeller 30. This relation of the vertical pressure-exerted area portions is established in both the front and back surfaces of the impeller 30.

Although the impeller 30 has different shapes at its front and back surfaces, respectively, in association with the horizontal pressure-exerted area portions, it has the same horizontal pressure-exerted area at the front and back surfaces, taking into consideration the fact that pressure is always exerted on a face in a direction perpendicular to the plane of the face.

Now, forces applied to the impeller 30 in accordance with the above mentioned relations of the pressure-exerted area portions will be described in conjunction with the Expression 1. Although the pressures respectively exerted on the front and back surfaces of the impeller 30 are different from each other, vertical forces respectively applied to the impeller 30 in opposite directions are offset by each other because opposite ones of the vertical pressure-exerted area portions have the same area. As a result, there is no vertical force component eventually exerted on the impeller 30 due to the vertical forces applied to the impeller 30 at the front and back surfaces of the impeller 30. Accordingly, the vertical force totally applied to the radial bearings (respectively denoted by the reference numerals 7 and 8 in FIG. 1) results from only the weight of the drive shaft.

In terms of horizontal forces applied to respective portions of the impeller 30, however, an axial bias force serving to urge the impeller 30 in a direction from the back surface of the impeller 30 to the front surface of the impeller 30 is generated because the low average pressure $P_1$ is exerted on the front surface of the impeller 30 whereas the high average pressure $P_2$ is exerted on the back surface of the impeller 30.

However, since the impeller 30 has a reduced horizontal pressure-exerted area by virtue of the above mentioned pressure attenuating grooves 30*c* in accordance with the present invention, the axial bias force is correspondingly reduced. Accordingly, the force applied to the thrust bearings (denoted by the reference numeral 6 in FIG. 1) is reduced.

Figure 1:
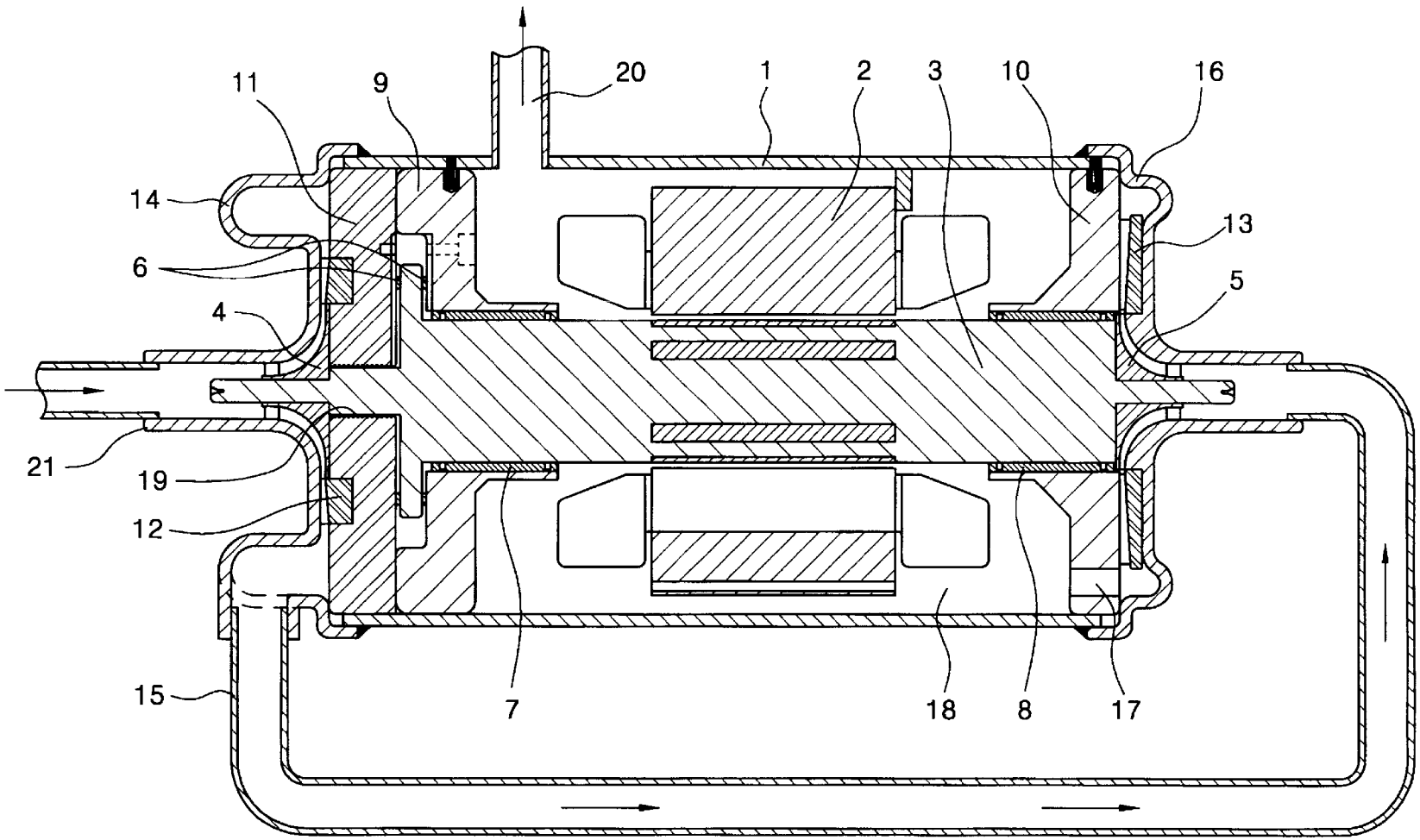
Fig. 1 (PRIOR ART)
FIG. 1 is a sectional view illustrating the structure of a conventional two-stage centrifugal compressor.
Figure 2:
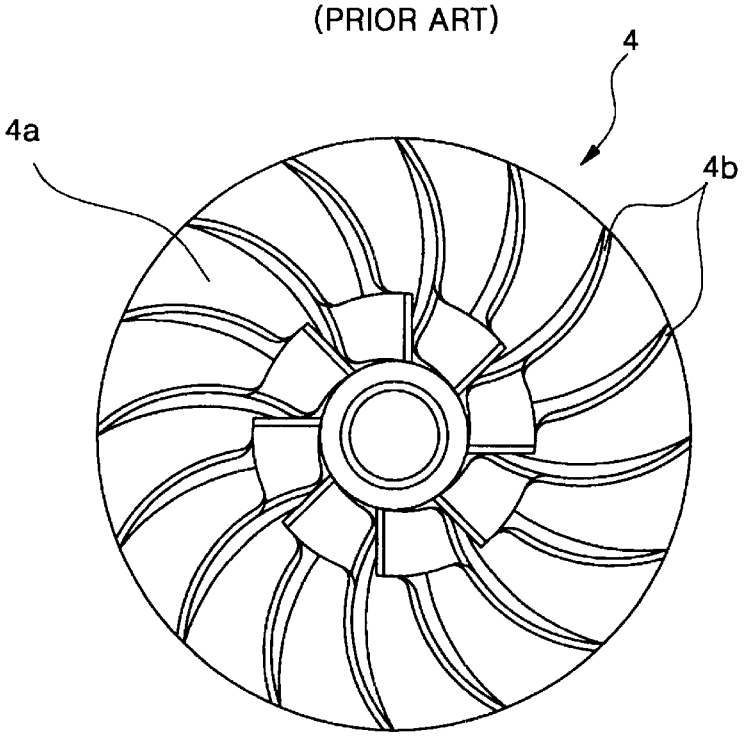
Fig. 2 (PRIOR ART)
FIG. 2 is a plan view illustrating one of conventional impellers used in the conventional centrifugal compressor.
Figure 3:
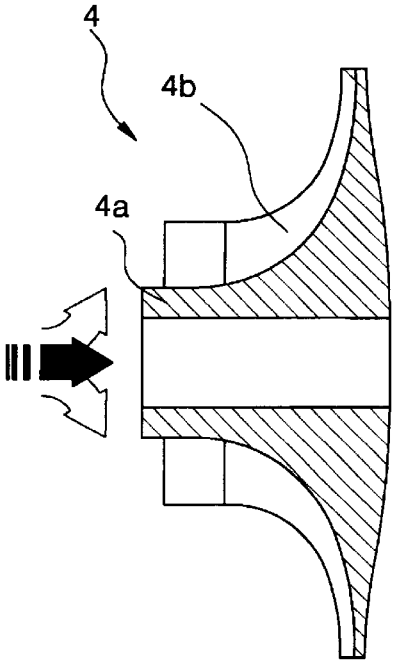
Fig. 3 (PRIOR ART)
FIG. 3 is a sectional view illustrating the conventional impeller.
Figure 4:
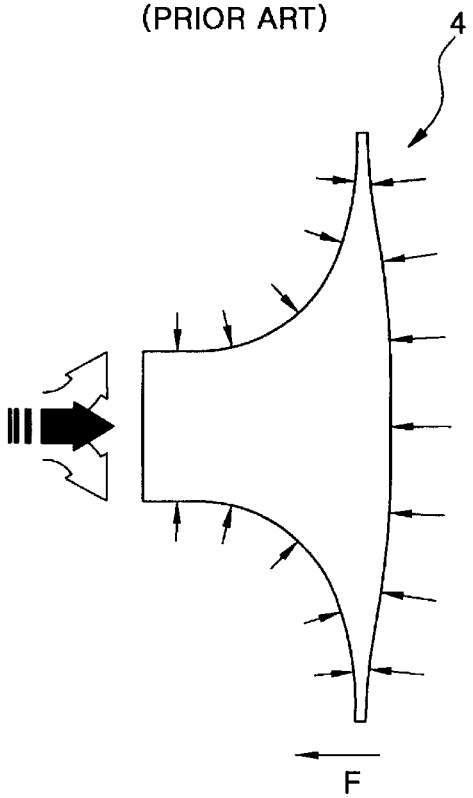
Fig. 4 (PRIOR ART)
FIG. 4 is a schematic view illustrating a load applied to the conventional impeller.
Figure 8:
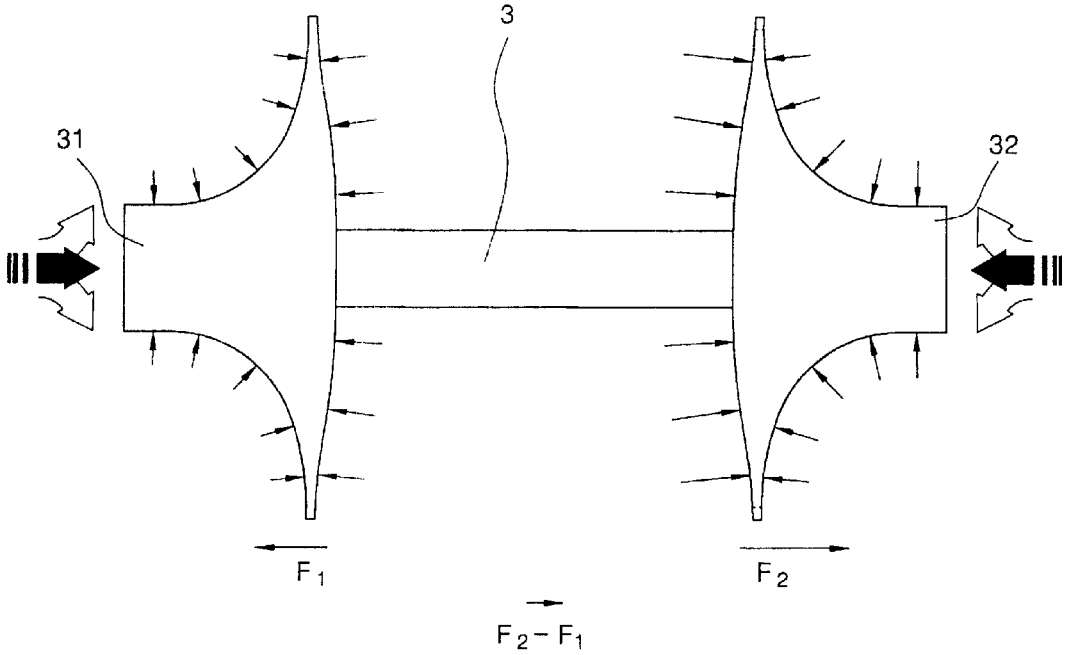
FIG. 8 is a schematic view illustrating the impeller structure according to the present invention, which is applied to a two-stage centrifugal compressor.

Such an effect is remarkably exhibited in two-stage centrifugal compressors involving two compression stages. This will be described in detail in conjunction with FIG. 8. FIG. 8 schematically illustrates the impeller structure according to the present invention, which is applied to a two-stage centrifugal compressor having a configuration as shown in FIG. 1.

Referring to FIG. 8, the two-stage centrifugal compressor includes a first impeller 31 adapted to compress a fluid to a low pressure, a second impeller 32 adapted to compress again the compressed fluid to a high pressure, and a drive shaft 3 connected with the first and second impellers 31 and 32 at opposite ends thereof, respectively, so that it rotates along with the first and second impellers 31 and 32.

In this centrifugal compressor, there is a low pressure difference across the first impeller 31 because an external fluid directly introduced into the first impeller 31 is compressed to a low pressure by the first impeller 31. By virtue of such a low pressure difference across the first impeller 31, the force exerted on the first impeller 31 in a direction from the back surface of the first impeller 31 to the front surface of the first impeller 31, that is, a bias force $F_1$, has a low level, as apparent from the Expression 1. On the other hand, the force exerted on the second impeller 32 in a direction from the back surface of the second impeller 32 to the front surface of the second impeller 32, that is, a bias force $F_2$, is higher than the bias force $F_1$ by virtue of a high pressure difference generated across the second impeller 32. This is also apparent from the Expression 1.

Where pressure attenuating grooves (denoted by the reference numeral 30*c* in FIG. 5) are formed at the second impeller 32 to reduce the horizontal force exerted on the drive shaft 3 in accordance with the present invention, the fraction of the horizontal force reduced by the pressure attenuating grooves is adjusted to correspond to a difference between the force $F_2$ applied to the second impeller 32 without the provision of the pressure attenuating grooves and the force $F_1$ applied to the first impeller 31, that is, "$F_2-F_1$". In accordance with such an adjustment, it is possible to more easily remove the axial load, as compared to the conventional method in which the impellers have difference sizes to adjust the force difference "$F_2-F_1$". Thus, it is possible to easily and conveniently prevent the thrust bearings (denoted by the reference numeral 6 in FIG. 1) from being damaged, in accordance with the present invention.

In accordance with the present invention, an effective reduction in axial load is achieved without any variation in the fluid compression degree of each impeller only by forming grooves of a uniform depth at the outer peripheral edge of the hub between adjacent ones of the blades without varying the size and length of each blade determining the fluid compression degree.

Although the impeller of the present invention has been described as being applied to centrifugal compressors involving two compression stages, it may be applied to centrifugal compressors using an increased number of impellers to involve an increased number of compression stages. In this case, a convenience of design may be achieved by arranging mating ones of impellers to face each other at their back surfaces.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

As apparent from the above description, the present invention provides a centrifugal compressor structure using impellers, in which pressure attenuating grooves are provided at the outer peripheral edge of the hub in each impeller without any variation in the size and length of each blade serving as important factors for adjusting the fluid compression degree of the impeller, so that thrust bearings adapted to support an axial load are effectively protected, thereby eliminating problems resulting from the thrust bearings.

In addition to the effect of protecting the thrust bearings, it is possible to avoid an undesirable reduction in compression ratio resulting from a reduction in the size of the impeller.

In accordance with the present invention, the axial load adjustment is simplified by determining an appropriate size of the pressure attenuating grooves formed at the peripheral edge of the hub in each impeller using a procedure of gradually increasing the size of the pressure attenuating grooves until a desired groove size is obtained. In accordance with conventional methods, a number of trials and errors are inevitably involved in achieving a desired axial load adjustment. Thus, the present invention effectively eliminates a variety of problems involved in designing centrifugal compressors.

What is claimed is:

1. A two-stage centrifugal compressor comprising:

a motor;

a drive shaft which rotates via an output of said motor;

a first impeller attached to said drive shaft, said first impeller receiving fluid from a first entry, pressurizing the fluid and sending the fluid to a first exit; and a second impeller, spaced from said first impeller and attached to said drive shaft, said second impeller receiving fluid from a second entry, pressurizing the fluid and sending the fluid to a second exit, wherein said second impeller includes:

a hub coupled to said drive shaft;

a plurality of blades provided on a first face of said hub; and a plurality of pressure attenuating grooves provided at an outer peripheral edge of said hub and adapted to reduce an axial load applied to said second impeller.

2. The two-stage centrifugal compressor according to claim 1, wherein said plurality of pressure attenuating grooves are uniformly-shaped, and spaced uniformly each from the other along said outer peripheral edge of said hub of said second impeller.

3. The two-stage centrifugal compressor according to claim 1, wherein each one of said plurality of pressure attenuating grooves is positioned between adjacent blades.

4. The two-stage centrifugal compressor according to claim 1, wherein a second face of said hub of said second impeller presents a smooth surface.

5. The two-stage centrifugal compressor according to claim 1, wherein said first impeller is attached to said drive shaft proximate a first end of said drive shaft, and said second impeller is attached to said drive shaft proximate a second end of said drive shaft.

6. The two-stage centrifugal compressor according to claim 1, wherein said first exit is in fluid communication with said second entry.

7. An impeller for use in a two-stage centrifugal compressor comprising:

a hub for coupling to a drive shaft of a motor, said hub including a first face and a second face, opposite said first face;

a plurality of blades projecting away from said first face of said hub; and a substantially smooth surface formed on said second face of said hub;

a plurality of pressure attenuating grooves provided at an outer peripheral edge of said hub, said plurality of pressure attenuating grooves reducing an overall surface area of said second face to thereby reduce an load force acting on said second face caused by pressurized fluid adjacent to said second face.

8. The impeller according to claim 7, wherein said plurality of pressure attenuating grooves are spaced uniformly each from the other along said peripheral edge of said hub.

9. The impeller according to claim 7, wherein each one of said plurality of pressure attenuating grooves is positioned between adjacent blades.

10. The impeller according to claim 7, wherein each of said plurality of pressure attenuating grooves have a uniform shape.

11. The impeller according to claim 10, wherein each one of said plurality of pressure attenuating grooves is positioned between adjacent blades.

12. The impeller according to claim 10, wherein said plurality of pressure attenuating grooves are spaced uniformly each from the other along said peripheral edge of said hub.

13. The impeller according to claim 12, wherein each one of said plurality of pressure attenuating grooves is positioned between adjacent blades.

* * * * *